US008706327B2

(12) United States Patent
Peltz et al.

(10) Patent No.: US 8,706,327 B2
(45) **Date of Patent: *Apr. 22, 2014**

(54) METHOD AND SYSTEM FOR PROVIDING REDUNDANCY IN RAILROAD COMMUNICATION EQUIPMENT

(75) Inventors: David Michael Peltz, Melbourne, FL (US); Robert James Foy, Melbourne, FL (US); Mark Bradshaw Kraeling, Melbourne, FL (US); Mark Wheeler, Palm Bay, FL (US); Brian Lee Staton, Palm Bay, FL (US)

(73) Assignee: General Electric Company, Schenectady, NY (US)

( * ) Notice: Subject to any disclaimer, the term of this patent is extended or adjusted under 35 U.S.C. 154(b) by 172 days.

This patent is subject to a terminal disclaimer.

(21) Appl. No.: 13/168,942

(22) Filed: Jun. 25, 2011

(65) Prior Publication Data

US 2011/0249628 A1 Oct. 13, 2011

Related U.S. Application Data

(62) Division of application No. 12/848,513, filed on Aug. 2, 2010, now Pat. No. 8,112,189, which is a division of application No. 10/914,886, filed on Aug. 10, 2004, now Pat. No. 7,783,397.

(60) Provisional application No. 60/531,796, filed on Dec. 22, 2003.

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/19

(58) Field of Classification Search
USPC ..... 104/130.01, 26.1; 105/26.05; 116/28 R; 246/111, 117, 13, 15, 165, 167 R, 18, 246/182 AA, 182 AB, 187 A, 187 R, 192 R, 246/193, 194, 196, 1 R, 20, 218, 2 R, 3, 246/473 R, 7; 340/1.1, 12.1, 12.5, 13.25, 340/286.02, 508, 532, 539.1, 539.16, 340/539.17, 825.01, 825.52, 825.53; 370/389, 471; 375/130, 295; 455/103, 455/3.01, 3.06, 66.1, 899; 701/1, 19, 20
See application file for complete search history.

(56) References Cited

U.S. PATENT DOCUMENTS

| | | | | |
|---|---|---|---|---|
| 4,159,469 | A * | 6/1979 | Zdunek | 714/786 |
| 4,447,903 | A * | 5/1984 | Sewerinson | 714/821 |
| 5,039,038 | A * | 8/1991 | Nichols et al. | 246/3 |
| 5,247,523 | A * | 9/1993 | Arai et al. | 714/755 |
| 5,282,209 | A | 1/1994 | Bonnerot | |

(Continued)

*Primary Examiner* — Khoi Tran
*Assistant Examiner* — Nicholas Kiswanto
(74) *Attorney, Agent, or Firm* — GE Global Patent Operation; John A. Kramer

(57) ABSTRACT

A railway communication system (10) includes a transmitter (12) receiving an input and producing a communication signal (18). The communication signal (18) includes at least two different portions (20,22) for separately encoding respective indications (38,40) of the input. The system also includes a receiver (14) coupled to a controlled device, the receiver (14) extracting at least one of the respective indications (38,40) from the communication signal (18). The receiver controls the device responsive to the at least one extracted indications (38,40).

12 Claims, 1 Drawing Sheet

(56) References Cited

U.S. PATENT DOCUMENTS

| | | | | |
|---|---|---|---|---|
| 5,420,883 | A * | 5/1995 | Swensen et al. | 375/138 |
| 5,535,191 | A * | 7/1996 | Park | 370/228 |
| 5,570,284 | A | 10/1996 | Roselli et al. | |
| 5,577,196 | A * | 11/1996 | Peer | 714/4.1 |
| 5,685,507 | A | 11/1997 | Horst et al. | |
| 5,805,797 | A * | 9/1998 | Sato et al. | 714/48 |
| 6,272,190 | B1 * | 8/2001 | Campana, Jr. | 375/347 |
| 6,401,015 | B1 | 6/2002 | Stewart et al. | |
| 6,449,536 | B1 * | 9/2002 | Brousseau et al. | 701/19 |
| 6,628,649 | B1 * | 9/2003 | Raj et al. | 370/360 |
| 6,631,873 | B2 | 10/2003 | Fisher | |
| 6,687,231 | B1 | 2/2004 | Czerwiec et al. | |
| 6,826,514 | B1 * | 11/2004 | Antico et al. | 702/188 |
| 6,853,890 | B1 * | 2/2005 | Horst et al. | 701/20 |
| 6,863,247 | B2 * | 3/2005 | Horst | 246/187 A |
| 6,975,927 | B2 * | 12/2005 | Szklar et al. | 701/19 |
| 7,069,122 | B1 * | 6/2006 | Higgs | 701/19 |
| 7,120,845 | B2 * | 10/2006 | Kwon et al. | 714/746 |
| 7,174,497 | B2 | 2/2007 | Baggen et al. | |
| 7,185,261 | B2 | 2/2007 | Heppe | |
| 7,734,287 | B2 * | 6/2010 | Ying | 455/423 |
| 2003/0084395 | A1 | 5/2003 | Bryant et al. | |
| 2003/0093747 | A1 * | 5/2003 | Brouet et al. | 714/776 |
| 2003/0177436 | A1 * | 9/2003 | Gruhn et al. | 714/776 |
| 2003/0226091 | A1 * | 12/2003 | Platenberg et al. | 714/776 |
| 2004/0049327 | A1 * | 3/2004 | Kondratenko et al. | 701/19 |
| 2004/0088086 | A1 | 5/2004 | Horst | |
| 2004/0100938 | A1 * | 5/2004 | Aiken et al. | 370/346 |
| 2004/0129840 | A1 * | 7/2004 | Horst | 246/186 |
| 2004/0261007 | A1 | 12/2004 | Heppe | |
| 2005/0065673 | A1 * | 3/2005 | Horst et al. | 701/19 |
| 2007/0162829 | A1 | 7/2007 | Wei et al. | |
| 2010/0029284 | A1 * | 2/2010 | Feher | 455/440 |

* cited by examiner

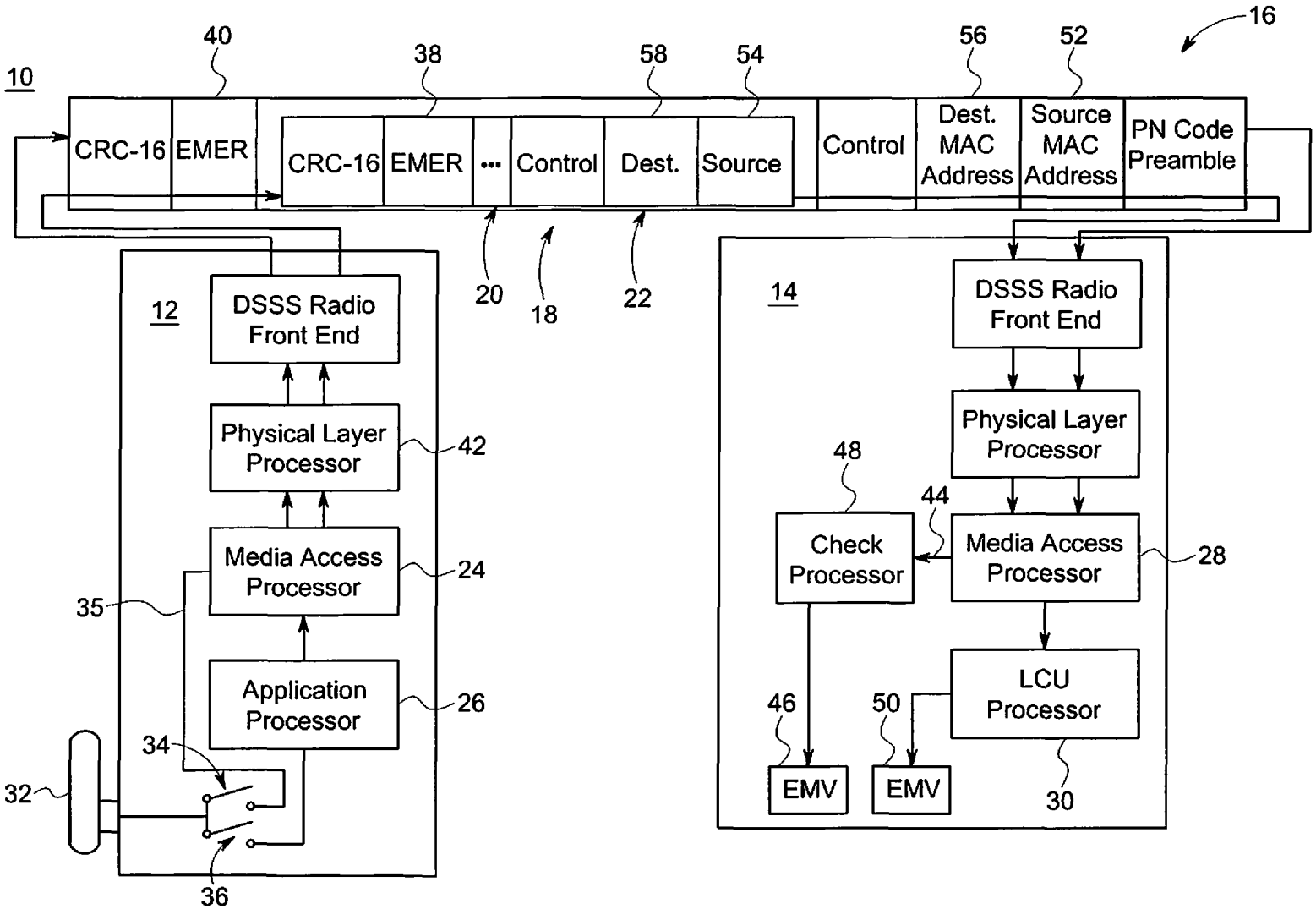
16
PN Code Preamble
Source MAC Address
Dest. MAC Address
Control
Source
Dest.
Control
...
EMER
CRC-16
EMER
CRC-16
52
56
54
58
38
40
22
18
20
10
DSSS Radio Front End
Physical Layer Processor
Media Access Processor
LCU Processor
Check Processor
EMV
EMV
14
28
30
44
48
50
46
DSSS Radio Front End
Physical Layer Processor
Media Access Processor
Application Processor
12
42
24
26
34
36
35
32

METHOD AND SYSTEM FOR PROVIDING REDUNDANCY IN RAILROAD COMMUNICATION EQUIPMENT

CROSS-REFERENCE TO RELATED APPLICATIONS

This application is a Divisional of U.S. application Ser. No. 12/848,513 filed 2 Aug. 2010, now U.S. Pat. No. 8,112,189 which is a Divisional of U.S. application Ser. No. 10/914,886 filed 10 Aug. 2004, now U.S. Pat. No. 7,783,397 which application claims benefit of the 22 Dec. 2003 filing date of U.S. Provisional Application No. 60/531,796, and incorporated herein by reference in its entirety.

BACKGROUND OF THE INVENTION

This invention relates generally to the field of locomotives, and more particularly to a system for providing redundant communication paths in railroad communication equipment.

Electronic communication equipment is widely used in railroad environments for controlling railway assets, such as locomotives operating in a railroad system. For example, it is known to remotely control locomotives in a switchyard using remote radio transmitting devices controlled by rail yard personnel. Such systems may include an operator control unit (OCU) or control tower unit in remote communication with a locomotive control unit (LCU) on board a controlled locomotive. The LCU may direct the locomotive to move and stop according to transmitted commands. Integrity of the communication path between a remotely controlled locomotive and a remote controller is critical to safe remote control operations. A margin of safety may be provided by incorporating redundancy in a remote control system, such as by using redundant hardware, software, and radio messaging. However, a federally allocated radio spectrum bandwidth for locomotive remote control communications may not have sufficient bandwidth to support additional content for providing radio messaging redundancy. Furthermore, portability issues and relatively low power operating requirements may limit incorporating additional hardware and software to provide redundancy.

BRIEF DESCRIPTION OF THE INVENTION

In one embodiment, a communication system of the present invention comprises a transmitter comprising a first and a second transmitter processor, each transmitter processor separately receiving independent inputs responsive to operator control of an actuator, the transmitter processors operating together producing a communication signal comprising first and second different data areas, each data area separately encoding indications of the independent inputs, wherein each processor operates independently to encode the respective first and second data areas of the communication signal responsive to the independent inputs; the communications signal transmitted from the at least two different transmitters over a free-space communications link; a receiver for receiving the communications signal and comprising at least two receiver processors, each receiver processor coupled to a respective and independently controlled device, a first one of the receiver processors extracting one of the respective indications from the first data area and controlling a first device responsive thereto and a second one of the receiver processors separately extracting one of the respective indications from the second data area and controlling a second device responsive thereto; and the first and the second data areas, the first and the second transmitter processors and the first and the second devices comprising independent parallel data paths from the communications link.

In another embodiment, a communication system utilizing multiple processors for encoding both media access information and application information into a single message data stream, embodies a method of the present invention that provides redundancy for a safety-critical function. The method comprises: using a first of the multiple processors but not a second of the processors to encode first safety critical data into the message wherein the first safety critical data is encoded within the media access information, the first safety critical information generated by a first switch controlled by an operator control unit; using the second of the multiple processors but not the first of the processors to encode second safety critical data redundant with the first safety critical data into the message, wherein the second safety critical data is encoded within the application information, the second safety critical information generated by a second switch controlled by the operator control unit, the first switch parallel with the second switch, the first and the second switches simultaneously operable responsive to operation of the operator control unit; transmitting the message over an over-the-air communications link; receiving the first safety critical information at a first receiver; receiving the second safety critical information at a second receiver; a first device responsive to the first receiver responding to the first safety critical information; a second device responsive to the second receiver responding to the second safety critical information; and the first and the second receivers and the first and the second devices comprising two independent parallel data paths from the communications link.

BRIEF DESCRIPTION OF THE DRAWINGS

The invention will be more apparent from the following description in view of the sole FIGURE that shows:

The FIGURE is a block diagram of a system for providing redundant communication paths in locomotive remote control transceivers.

DETAILED DESCRIPTION OF THE INVENTION

In many railway communication systems, an ability to provide redundant information is desired and may, in some cases, be required by regulating agencies to ensure reliable and safe operation of the railway assets served by the communication system. While information redundancy may be provided for all information that may be transmitted among transceivers in a railway communication system, it is particularly desired to provide redundancy for certain safety-critical functions in a locomotive remote control system to prevent accidents that might occur should a certain safety critical piece of information fail to be transmitted and/or received. Such functions may include: ensuring that an operator initiated emergency command is delivered to a locomotive; ensuring that control messages are received at a desired periodic rate; ensuring that a locomotive being remotely controlled only responds to a single designated remote controller; and ensuring that data errors cannot cause erroneous operation. Such functions may need more than a single communication path through the remote control system. The inventors have innovatively realized that command redundancy may be incorporated into a railway communication system, such as a locomotive remote control system, with minimal modification by sending a command in two different locations of a radio message packet, such as by embedding the redundant messages in two different layers of the radio packet. To add further redundant capability, the two different locations may be processed in two different processors of each transceiver. These two different processors may include existing processors used to process communications or application information, and/or they may include a processor dedicated to the safety-critical function. Accordingly, separate, redundant communication paths may be established between transceivers in a locomotive remote control system to provide continuous communication capability should one communication path fail. Advantageously, such redundant communication paths may insure that information, such as safety-critical commands, are transmitted without requiring redundant transmission of an entire message packet, which may be difficult to achieve in narrow bandwidth applications. In addition, redundant communication paths within each of the transceivers provides a margin of safety for ensuring that message packets are transmitted and received to prevent, for example, inadvertent stopping of a locomotive expecting to receive radio packets at a desired repetition rate. In another aspect, redundant confirmation of received control commands are provided to ensure the locomotive only responds to an authorized remote controller. Furthermore, received commands may be redundantly checked to ensure that data errors do not cause incorrect operation.

The sole FIGURE shows a block diagram of a railroad communication system 10 for providing redundant communication paths in locomotive remote control transceivers. In an embodiment of the invention, the system 10 may include a portable OCU 12 transceiver in communication with an LCU 14 transceiver located onboard a locomotive. Two-way communication between the OCU 12 and LCU 14 may be provided over communication link 16. The OCU 12 and LCU 14 may communicate using packetized radio messages. For example, a radio message packet 18 transmitted between the OCU 12 and LCU 14 may include an application layer 20 encapsulated within a media access layer 22. The application layer may include control information responsive to switch settings on the OCU 12, and the media access layer 22 may include transmission information, such as transceiver identification data. In an aspect of the invention, each transceiver 12, 14 may include two processors for encoding transmitted message packets 18 and for decoding received radio message packets 18. One of the two processors may be configured to process application layer information, and the other processor may be configured to process media access layer information. For example, the OCU 12 may include an application processor 26 for encoding OCU actuator conditions indicative of desired remote control commands, and a media access processor 24 for generating the media access layer information. The LCU 14 may include a media access processor 28 for stripping the media access layer information from a received message packet 18 and a LCU processor 30 for decoding received OCU actuator conditions in the application layer information.

In an embodiment of the invention, two different processors may be used to independently detect condition of an actuator, such as an emergency actuator 32. The emergency actuator 32 may be coupled to include two redundant switches 34, 36, each switch coupled to a respective processor. For example, application processor 26 may be coupled to switch 36, and media access processor 24 may be coupled to switch 34. In an aspect of the invention, the media access processor 24 may include an input line 35 responsive to the position of the switch 34. Each processor 26, 24 may encode a detected switch position 38 in a different portion, or different layer, of the transmitted packet 18 without impacting or depending upon the operation of the other processor 24, 26. For example, application processor 26 may encode the detected switch position 38 for switch 34 as a single bit in the application layer 20 of a transmitted packet 18, while media access processor 24 may encode the detected switch position 40 for switch 36 as a single bit in the media access layer 22 of a transmitted packet 18. A physical layer microprocessor 42 may assemble the application layer 20 and the media access layer 22 into the packet 18 for transmission to the LCU 14. Accordingly, the packet 18 may be encoded with redundant control information for an actuator condition, such as the emergency switch 32 setting, for incorporation in the packet 18. Advantageously, actuator condition information, such as a single bit set responsive to a two-position switch, may be provided for incorporation in the packet 18 along redundant paths. If one of the switches 34, 36 or one of the processors 24, 26 should fail, the other switch 36, 34 or other processor 26, 24 in the redundant path may still provide the appropriate information for incorporation into at least one layer of the packet 18 for transmission to the LCU 14.

The LCU 14 may include at least two processors for separately extracting the redundant control information from a received packet 18 and at least two separate control paths for providing control commands to a locomotive responsive to the redundant control information encoded in the packet 18. For example, in one control path, the media access processor 28 of the LCU 14 may be configured to extract the redundant control information from the media access 22 layer of the packet 18 and to provide an output 44 to control an actuator responsive to the extracted control information for controlling the locomotive, such as by opening an emergency control valve 46, 50 in response to receiving an emergency switch 32 activation indication in the control information. In an aspect of the invention, a dedicated or special check processor 48 may be provided and coupled to the media access processor 28 to extract the redundant control information from the media access 22 layer or to forward a control signal generated by the media access processor 28 to an appropriate actuator.

In a parallel control path, the LCU processor 30 may be configured to extract the redundant control information from the application layer 20 of the packet 18 and control the locomotive in response to the extracted control information. In an aspect of the invention, redundant actuators, such as redundant emergency control valves 46, 50 may be provided in the respective control paths to achieve redundant, independent control responsive to separate control signals provided via separate control paths. Advantageously, the control information extracted from a received packet may be provided along redundant, independent paths to provide a safety margin should a component fail in any one of the control paths. If one of the actuators, such as one of the emergency control valves 46, 50, or one of the processors 28, 30 should fail, the other valve 50, 46, or other processor 30, 28, in the redundant path may still provide the received control information for controlling the locomotive.

In yet another embodiment, redundant control paths as described above may be used to detect and respond to a loss of communication between the OCU 12 and LCU 14. Typically, the LCU 14 expects to receive a packet 18 from a controlling OCU 12 at a predetermined repetitive rate. For example, the LCU 14 may be configured to expect a subsequent packet 18 within five seconds of receiving a previous packet 18. If the LCU 14 does not detect a packet 18 within a predetermined period of time after a prior received packet 18, the LCU may determine that a loss of communication has occurred and may, as a safety measure, place the locomotive in an emergency stop condition. To avoid an unintentional loss of communication, independent redundant paths to two independent processors, such as the LCU processor 30 and check control processor 48, may be provided to ensure that communications have indeed been lost and that a detected loss of communication is not the result of a failure within the LCU 14 or missing data in the packet 18, potentially rendering the packet 18 unidentifiable.

A typical packet 18 includes radio identification information, such as radio source identifiers 52, 54 and radio destination identifiers 56, 58, encoded, for example, in the header of both the media access layer 22 and the application layer 20. Radio identification information from the media access layer 22 may be passed through the media access processor 28 to the check processor 48 to verify presence of expected header information, such as a radio source identifier 52 in the media access layer 22. In an aspect of the invention, the verification process performed in the check processor 48 may be performed in the media access processor 28. To provide redundancy, the media access processor 28 may also forward the radio identification information from the application layer 22 along an independent path to the LCU processor 30. Accordingly, presence of expected header information, such as a radio source identifier 54 in the media access layer 20 may be independently verified in each processor 48, 28. By innovatively providing redundant processors and redundant pathways in the LCU 30, loss of one set of header information, for example, one of the radio source identifiers 52, 54, or one of the processors 30, 48 (which might otherwise result in a failure of the LCU to identify a valid packet 18) may be verified to prevent the LCU from inadvertently ignoring an otherwise valid packet 18. The other processor 48, 30 in the redundant path may still be able to identify a received packet as a valid packet and response to encoded command appropriately instead of indicating a lost communication condition.

In a further aspect, the media access processor 28 and LCU 14 processor 30 may act independently to verify that a received packet is intended for the receiving LCU 14. For example, the media access processor 28 may be configured to check the radio source identifier 52 and the radio destination identifier 56 in the media access layer 22 to verify that the packet 18 is intended for the receiving LCU 14 and that a radio source, or OCU 12, generating the packet 18 is recognized as a controller for the LCU 14. In addition, independent LCU processor 30 may be configured to check the radio source identifier 54 and the radio destination identifier 58 in the application layer 20 to verify that the packet 18 is intended for the receiving LCU 14 and that the radio source that generated the packet 18 is recognized as a controller for the LCU 14. Accordingly, redundant checking of a received packet 18 may be provided to determine if the received packet is valid for controlling the receiving LCU 14. For example, if the results of checking the radio source identifiers 52, 54 and radio destination identifiers 56,58 in the respective processors 30, 48 don't match, the received packet may be ignored by the LCU 14.

While the preferred embodiments of the present invention have been shown and described herein, it will be obvious that such embodiments are provided by way of example only. Numerous variations, changes and substitutions will occur to those of skill in the art without departing from the invention herein.

What is claimed is:

1. A method comprising:

encoding first safety data within media access information in a message using a first processor, the message including the media access information and application information, the first safety data generated by a first switch that is controlled by an operator control unit;

encoding second safety data within application information of the message using a second processor, the second safety data being redundant of the first safety data and generated by a second switch that is controlled by the operator control unit;

transmitting the message over a wireless communications link;

receiving the message and extracting the first safety data at a first receiver;

receiving the message and extracting the second safety data at a second receiver;

communicating the first safety data over a first data path to a first device that is responsive to the first receiver for responding to the first safety data; and communicating the second safety data over a parallel, second data path to a second device that is responsive to the second receiver for responding to the second safety data.

2. The method of claim 1 wherein the media access information comprises a first layer of the message and the application information comprises a second layer of the message.

3. The method of claim 1 wherein the first safety data represents a condition of the first switch and the second safety data represents a condition of the second switch.

4. The method of claim 1 wherein the first and the second switches comprise a ganged switch assembly having first and second switch wipers.

5. The method of claim 1 wherein each of the media access information and the application information comprises a cyclic redundancy check (CRC) error detecting code.

6. The method of claim 1 wherein at least one of:

the first safety data is communicated to the first device that includes a first emergency control valve that operates responsive to the first safety data, or the second safety data is communicated to the second device that includes a second emergency control valve that operates responsive to the second safety data.

7. The method of claim 1 wherein the application information is encapsulated within the media access information in the message.

8. The method of claim 1 wherein the first safety data comprises a single bit indicating a condition of the first switch and the second safety data comprises a single bit indicating a condition of the second switch.

9. The method of claim 1 wherein the media access information comprises first data bits representative of a first error detecting code and the application information comprises second data bits representative of a second error detecting code.

10. The method of claim 1 wherein the first and second processors that encode the first and second safety data in the message are part of the operator control unit that controls operations of a powered unit of a rail vehicle and the first and second receivers are part of a powered unit control unit that controls operations of the powered unit.

11. The method of claim 1, wherein the message includes one or more data packets.

12. The method of claim 1, wherein communicating the first safety data and communicating the second safety data includes communicating the first safety data and the second safety data over the first data path and the second data path, respectively, that are separate from the wireless communications link.

* * * * *